US006781326B2

(12) United States Patent
Stack

(10) Patent No.: US 6,781,326 B2
(45) Date of Patent: Aug. 24, 2004

(54) BALLAST WITH LAMP SENSOR AND METHOD THEREFOR

(75) Inventor: Tom Stack, Oxford, MI (US)

(73) Assignee: Q Technology Incorporated, Livermore, CA (US)

( * ) Notice: Subject to any disclaimer, the term of this patent is extended or adjusted under 35 U.S.C. 154(b) by 0 days.

(21) Appl. No.: 10/023,213

(22) Filed: Dec. 17, 2001

(65) Prior Publication Data

US 2003/0117084 A1 Jun. 26, 2003

(51) Int. Cl.[7] ..... G05F 1/00

(52) U.S. Cl. ..... 315/291; 315/224; 315/127; 315/307

(58) Field of Search ..... 315/291, 200 R, 315/224, 307, 119, 127, 225, DIG. 7, DIG. 5; 361/88, 89, 91.1, 18, 21

(56) References Cited

U.S. PATENT DOCUMENTS 5,140,229 A * 8/1992 Yagi et al. ..... 315/307
5,150,009 A * 9/1992 Kling et al. ..... 315/107
5,451,845 A * 9/1995 Ribarich ..... 315/225
5,635,799 A 6/1997 Hesterman ..... 315/127
5,770,925 A * 6/1998 Konopka et al. ..... 315/225
6,081,104 A * 6/2000 Kern ..... 323/268
6,087,776 A * 7/2000 Yamashita et al. ..... 315/82
6,181,084 B1 * 1/2001 Lau ..... 315/291
6,222,322 B1 4/2001 Stack ..... 315/119
6,534,930 B2 * 3/2003 Ito et al. ..... 315/291

OTHER PUBLICATIONS

Lamps and Lighting, Coaton et al., Published in Great Britain 1997 by Arnold, Fourth Edition, pp. 322–323.*

* cited by examiner

*Primary Examiner*—James Vannucci
*Assistant Examiner*—Thuy Vinh Tran
(74) *Attorney, Agent, or Firm*—Gifford, Krass, Groh, Sprinkle, Anderson & Citkowski, P.C.

(57) ABSTRACT

A ballast circuit is provided having an input, an output for coupling to an electric discharge lamp and an oscillation circuit for illuminating the lamp. A circuit may be included for sensing when a voltage on an input to the oscillation circuit exceeds desired levels. The ballast circuit may be shut down, limited or otherwise controlled to reduce the possibility of ballast failure.

40 Claims, 6 Drawing Sheets

BALLAST WITH LAMP SENSOR AND METHOD THEREFOR

FIELD OF INVENTIONS

These inventions relate to electronic ballasts.

BACKGROUND OF THE INVENTIONS

Gas discharge lamps such as fluorescent lamps require ballast in order to properly start and maintain lamp ignition to produce adequate light from the lamp. Ballast may be of electromagnetic, electronic or solid state types. With newer lamps, electronic ballast have been required in order to provide the necessary voltage and current to start the lamp and to maintain the required light output.

As a fluorescent lamp ages, several things can occur. For example, an emissive coating on the lamp filament may become depleted to the point the voltage drop from the filament to the arc stream is significantly increased because ionization of the gas in the lamp decreases due to the decrease in filament electron production. This causes the ballast to increase the voltage across the filament in an attempt to increase the current through the lamp in trying to provide the power apparently required by the lamp. As a result, switching devices commonly found in electronic ballast circuits may overheat and fail.

In another example, a lamp may become deactivated, wherein the gas fill of the lamp is either dissipated during use or was not present in sufficient amounts to efficiently fire the lamp. Even though the filaments of the lamp are acceptable, the lamp does not properly fire. The lamp no longer exhibits the necessary resistance to maintain the desirable impedance in the circuit, thereby presenting a relatively low impedance to the ballast. A low impedance permits a relatively high current to be generated in the ballast components, applying a high voltage and current to the lamp filaments. The ballast components operating at such high power levels may overheat and fail.

Occasionally, lamps may be improperly wired to a ballast, which may present a low impedance to the ballast. Another factor possibly affecting ballast performance includes incoming line voltages. Incoming line voltages may vary because of the effects of the presence of other external loads on the system, or they may be different than that for which the ballast was designed because of miswiring, for example. Significant voltage variations as seen by the ballast may therefore also cause component overheating and possible ballast failure.

Some electronic ballast may incorporate circuits to minimize or eliminate the possibility of component damage due to lamp failure. However, such circuits may be relatively expensive, include a relatively large number of components, or may require resetting the ballast before the ballast can again begin operation.

SUMMARY OF THE INVENTIONS

A ballast is provided herein which includes a circuit, component or method for detecting and/or protecting a ballast or its components from abnormal or undesirable lamp conditions or wiring configurations. The ballast according to the present invention may include a circuit that is more simple and lower in cost than other ballasts, and more reliable. In one form of the invention, the ballast can be restarted without having to be reset, and may include a suitable protective delay in restarting to minimize the possibility of components overheating or failing.

In one form of one of the inventions, a ballast circuit includes a ballast protection circuit coupled to an input circuit. The ballast protection circuit includes a voltage threshold detector, for example a diode, and a response circuit, for example a trigger circuit, for reducing or eliminating current to a lamp or other load. In one form, the ballast protection circuit is coupled to an input circuit, for example a DC input circuit, and includes at least one diode and preferably a plurality of diodes, from which the response circuit takes information for determining whether or not to reduce current to the load.

In another form of one of the present inventions, the ballast circuit having a protection circuit and a response circuit includes a plurality of diodes in the protection circuit. The response circuit includes a current conduction path, and the ballast circuit may further include at least one transistor for producing current for driving the lamp, wherein the current conduction path is coupled to a gate of the transistor. In one preferred embodiment, the response circuit includes a delay so that current to the lamp is not removed prematurely.

In one form of the inventions, a ballast circuit is provided having an input, an output for coupling to an electric discharge lamp and an oscillation circuit for illuminating the lamp. A circuit may be included for sensing when current from the oscillation circuit exceeds acceptable levels, at which point, the ballast circuit may be shut down, limited or otherwise reducing the possibility of ballast failure. In one form of the invention, a ballast protection circuit or, more specifically, a current excursion sensor circuit is coupled between the oscillation circuit and the output circuit for sensing when the current from the oscillation circuit exceeds a given value. Preferably, the invertor circuit is shut down and maintained inactive until such time as any current excursion has a chance to decay away, ballast components have an opportunity to cool off or otherwise return to normal condition or until such other condition has occurred. Preferably, the ballast is shut down upon a current or voltage excursion of such a magnitude at or before components may overheat or begin to fail.

In one form of the invention, a sensor circuit includes a silicon-controlled rectifier (SCR) for stopping, interrupting or shunting current in the ballast in order to shut the ballast down. Where the oscillation circuit includes switching transistors, the SCR can turn off one or both of the transistors to shut off the ballast. A capacitor may be included in the sensor circuit to help control the SCR, and may also provide a delay for preventing the ballast from restarting before conditions approach normal.

In another aspect of the invention, a ballast circuit is provided herein comprising an output circuit for producing a lamp drive current used for driving an electric discharge lamp; and a ballast protection circuit for protecting the output circuit from excessive lamp drive current that includes a current sensing resistor for producing across it a current sense voltage that varies as a function of the lamp drive current; and a device responsive to the current sensing voltage for causing the output circuit from producing the lamp drive current when the current sense voltage exceeds a predetermined voltage level indicative of excessive lamp drive current.

In yet another aspect of the invention, a method of protecting a ballast circuit from generating a lamp drive current that is excessive is provided herein, comprising the steps of sensing a current sensing voltage across a current sensing resistor that varies as a function of the lamp drive current; and preventing the ballast circuit from generating said lamp drive current if the current sensing voltage is within a predetermined voltage range indicating that an excessive lamp drive current exists.

DETAILED DESCRIPTION OF PREFERRED EMBODIMENTS OF THE INVENTIONS

Fluorescent lamps are used in many applications for providing lighting for commercial buildings, houses, warehouses, parking lots and other applications. One particular application of interest to the invention is the illumination of refrigeration systems. A fluorescent lamp driving circuit, typically termed a ballast, is usually employed in conjunction with the lamp to provide it a lamp drive current for causing the lamp to start illuminating, and to keep the lamp illuminated during normal operations.

Figure 1:
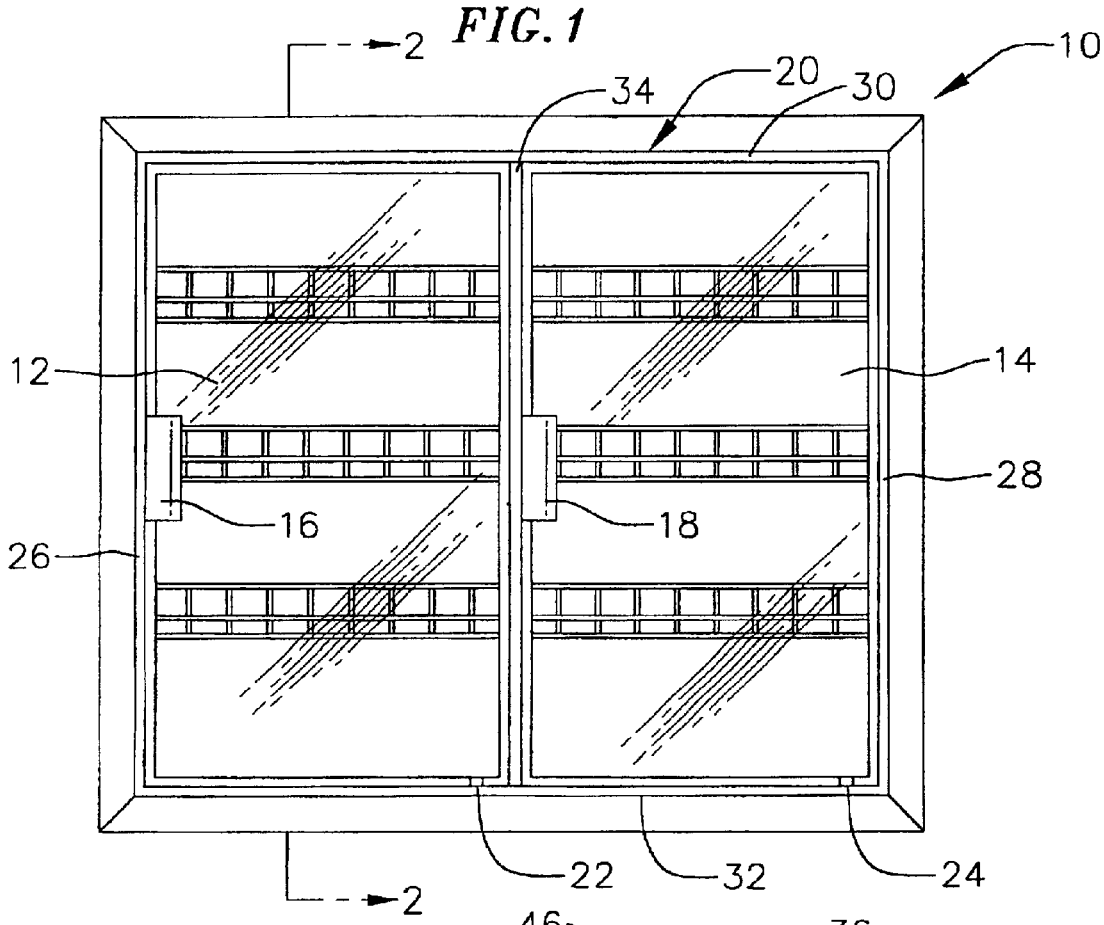
FIG. 1 is a front elevation of a refrigeration unit as per an aspect of the invention.

FIG. 1 illustrates one example of a refrigeration unit 10 which may be used in conjunction with, or from an element of, the present inventions. The refrigeration unit may be either a stand alone unit or a "built-in" unit. The refrigeration unit includes a pair of doors 12 and 14 which include handles 16 and 18, respectively. The doors 12 and 14 are pivotally mounted on a frame 20 by hinges 22 and 24. Frame 20 is secured to an opening in the refrigeration unit and consists of a pair of side members 26 and 26, a top member 30 and a bottom member 32. The frame may also include a mullion 34. Although not shown, a wire way may be associated with mullion 34, as well as other elements of frame 20, to provide passage for electrical wiring that is connected to the ballast.

Figure 2:
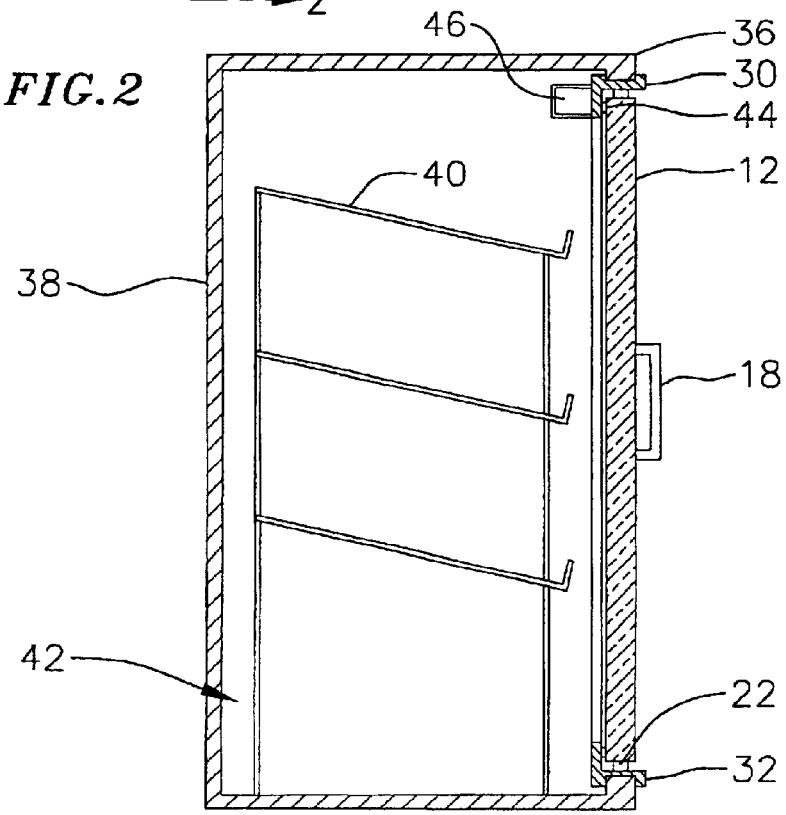
FIG. 2 is a section view taken along line 2—2 in FIG. 1.

Turning to FIG. 2, exemplary refrigeration unit may also include a front wall 36, a rear wall 38 and a shelving unit 40 disposed therebetween. The shelving unit's shelves may be slightly slanted, as shown, or horizontal. Additionally, the space between shelving unit 40 and rear wall 38 (indicated by reference numeral 42) may be larger enough to allow a person to pass through. A magnetic gasket-type seal 44 is also provided between the doors 12 and 14 and frame to prevent cold air from escaping from within the refrigeration unit.

In accordance with the illustrated embodiments, a ballast can 46 may be either permanently or removably attached to, or integral with, a portion of frame 20. In the view shown in FIG. 2, the difficulty associated with gaining access to a ballast stored in prior art ballast cans can be easily seen. It is difficult to service the ballast can by reaching into the refrigeration unit, around the ballast can and through an opening on the side of the ballast can facing rear wall 38. As discussed in detail below with reference to FIGS. 3–6, this problem in the art may be overcome by, for example, providing a ballast can opening which faces in a direction other than toward the rear or access to a ballast from another direction.

It is to be understood that, in accordance with the present inventions, ballast can 46 may best secured to the frame by any number of means. For example, the ballast can be attached to the frame through the use of hooks, hangers, screws, nut and bolt arrangements, rivets and other mechanical fastening devices. The ballast can also be attached through the use of soldering, welding, adhesive bonding, and other similar techniques. Magnetic devices may also be used to secure the ballast can to the frame and, as noted above, frame may be constructed with the ballast can 46 as an integral portion thereof.

Figure 3:
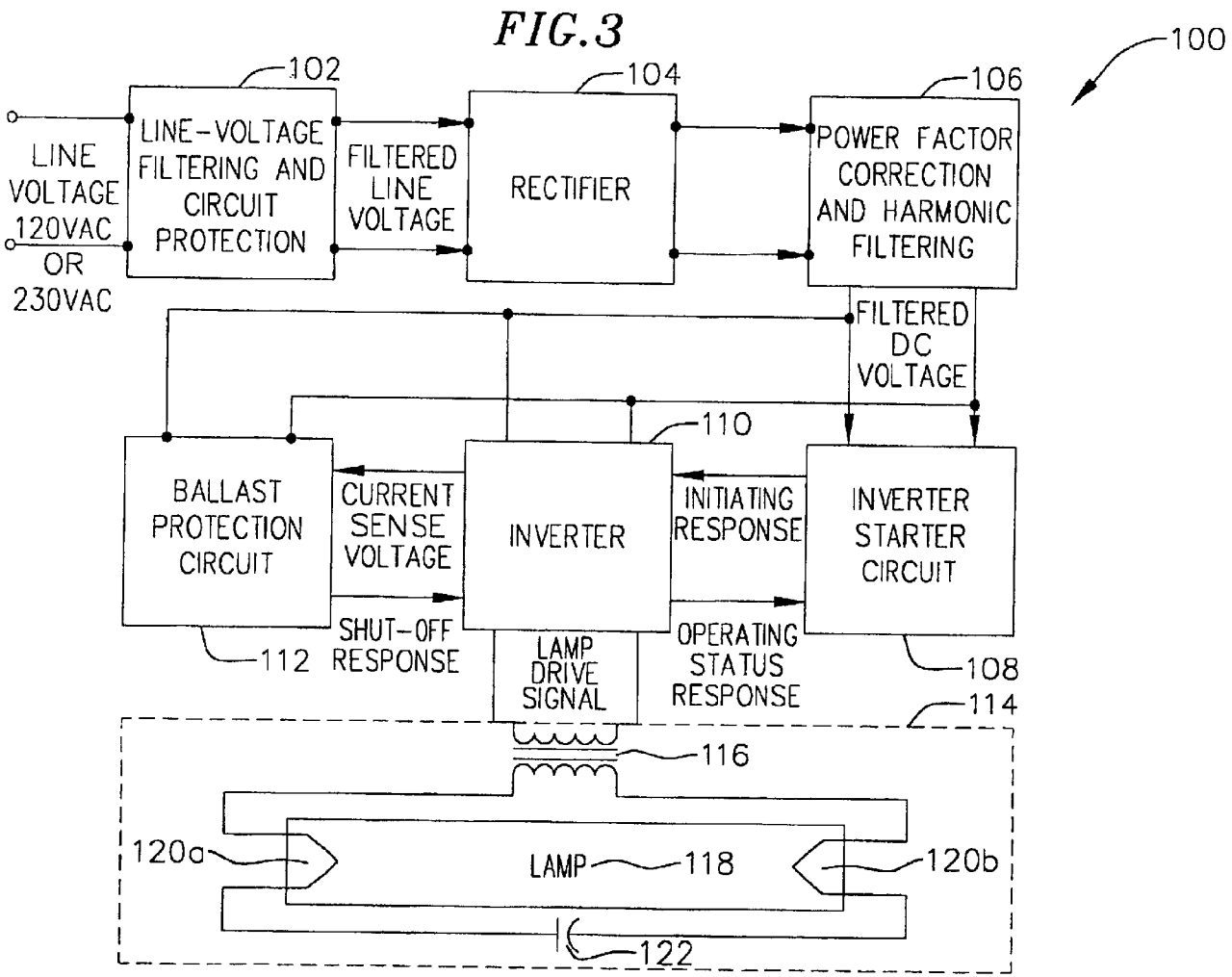
FIG. 3 is a block diagram of a ballast as per another aspect of the invention.

Referring to FIG. 3, a block diagram of the ballast 100 of the invention is shown coupled to a fluorescent lamp circuit 114 for providing thereto the driving current for illuminating the lamp. In the preferred embodiment, the ballast 100 comprises various functional circuits including a line-voltage filtering and circuit protection circuit 102, a rectifier circuit 104, a power factor correction and harmonic attenuation circuit 106, an inverter starter circuit 108, an inverter 110 and a ballast protection circuit 112. The ballast 100 is coupled to the lamp assembly 114 which includes an isolation and impedance-matching transformer 116, the fluorescent lamp 118, or more generally, an electric discharge lamp, and a starting capacitor 122.

The line-voltage filtering and circuit protection circuit 102 of the ballast 100 is used for filtering out noise that may be present in the line-voltage or produced by the ballast 100 itself. Such noise may include high-frequency noise or any other signals not part of the standard line-voltage being received. In the preferred embodiment, the standard line-voltage is 120 or 230 vac, 60 Hz. In addition, any noise that is generated by the ballast circuit is also filtered-out in order to prevent it from leaking out to the line-voltage. The line-voltage filtering and circuit protection 102 also provides protection to the ballast circuit against voltage surges, transients, voltage spikes, start-up surges and other unwanted noise that may cause damage to the ballast circuit.

The rectifier 104 and power factor correction and harmonic attenuation circuit 106 of the ballast 100 is used mainly for converting the filtered line-voltage generated at the output of the line-voltage filtering and circuit protection circuit 102 into a filtered DC voltage for use by the ballast circuit as a source of power. The power factor correction and harmonic attenuation circuit 106, as the name suggest, provides line-voltage power factor correction in order to increase the efficient use of real power by the ballast 100. In addition, the power factor correction and harmonic attenuation circuit 106 also provides for line-voltage harmonic attenuation, low and high frequency filtering and also filtering of incoming line pulses and energy fed back from the lamp circuit 114. Therefore, the power factor correction and harmonic attenuation circuit 106 outputs a filtered-DC voltage for use by the other elements of the ballast circuit, such as the inverter starter circuit 108, inverter 110 and the lamp protection circuit 112.

The inverter 100 of the ballast 100 produces the driving current for use by the lamp circuit 114 for continuously illuminating the fluorescent lamp 118. The driving current is preferably an oscillating square-wave of sufficient current and voltage for causing the fluorescent lamp 118 to continuously illuminate the lamp. As it will be explained in more detail later, the inverter 108 is generally an oscillating circuit preferably formed of a couple of transistors in a push-pull configuration and including a feedback circuit for creating the oscillating lamp drive current.

The inverter starter circuit 108 of the ballast 100 initiates the inverter 110 to start oscillating so that the oscillating lamp drive current is produced. The inverter starter circuit 108 initiates the oscillating of the inverter 110 by first determining whether the inverter 110 is oscillating by sensing an oscillating sense voltage. If the oscillating sense voltage is not present, meaning that the inverter 110 is not oscillating, the inverter starter circuit 108 produces an initiating pulse that is transmitted to one of the transistors of the inverter in order to cause them to oscillate. During start-up and during times when the inverter 110 stops oscillating for any of a number of reasons, the inverter starter circuit 108 will attempt to initiate the inverter 110 to oscillate.

The ballast protection circuit 112 of the ballast 100 protects the ballast circuitry, and specifically the inverter 110, from damage due to abnormal operations of the lamp circuitry 114. As discussed earlier, some abnormal operations of the lamp circuitry may be due to the aging of the fluorescent lamp 118 or the lamp becoming deactivated. In either case, the effects of such abnormal operations of the lamp circuit 114 on the ballast 100 is that the lamp drive current generated by the inverter 110 increases substantially. As a result, the inverter components, specifically the pair of push-pull transistors, heats up and potentially are damaged.

In order to prevent such damage to the inverter 110, the ballast protection circuit 112 continuously monitors the lamp drive current during the operation of the inverter. If the ballast protection circuit 112 determines that the lamp drive current exceeds a predetermined level, then it causes the inverter 110 from generating the lamp drive current; thereby, preventing the inverter components from over heating, and consequently, from incurring any damages. As will be discussed in more detail later, the ballast protection circuit 112 monitors the lamp drive current by sensing a voltage across a reference resistor situated in the path of the current. This voltage is designated herein as the current sense voltage. In response to excessive current level conditions, the ballast protection circuit 112 produces a "shut-off" response that prevents the inverter 110 from generating the lamp drive current.

The ballast 110 is coupled to the fluorescent lamp circuit 114 initially by way of an isolation and impedance matching transformer 116. Specifically, the inverter 110 of the ballast 100 has an output coupled in series with the primary winding of the transformer 116 for which the lamp drive current is applied to. The secondary winding of the transformer 116 is connected across the lamp 118 by way of the lamps' filaments 120*a–b*. A starting capacitor 122 is also connected across the lamp 118 also by way of the filaments 120*a–b*. The starting capacitor 112 allows current to flow through the lamp filaments 120*a–b* to heat them up during starting conditions so that the lamp gas is able to ignite and generate current through the lamp 118.

Figure 4:
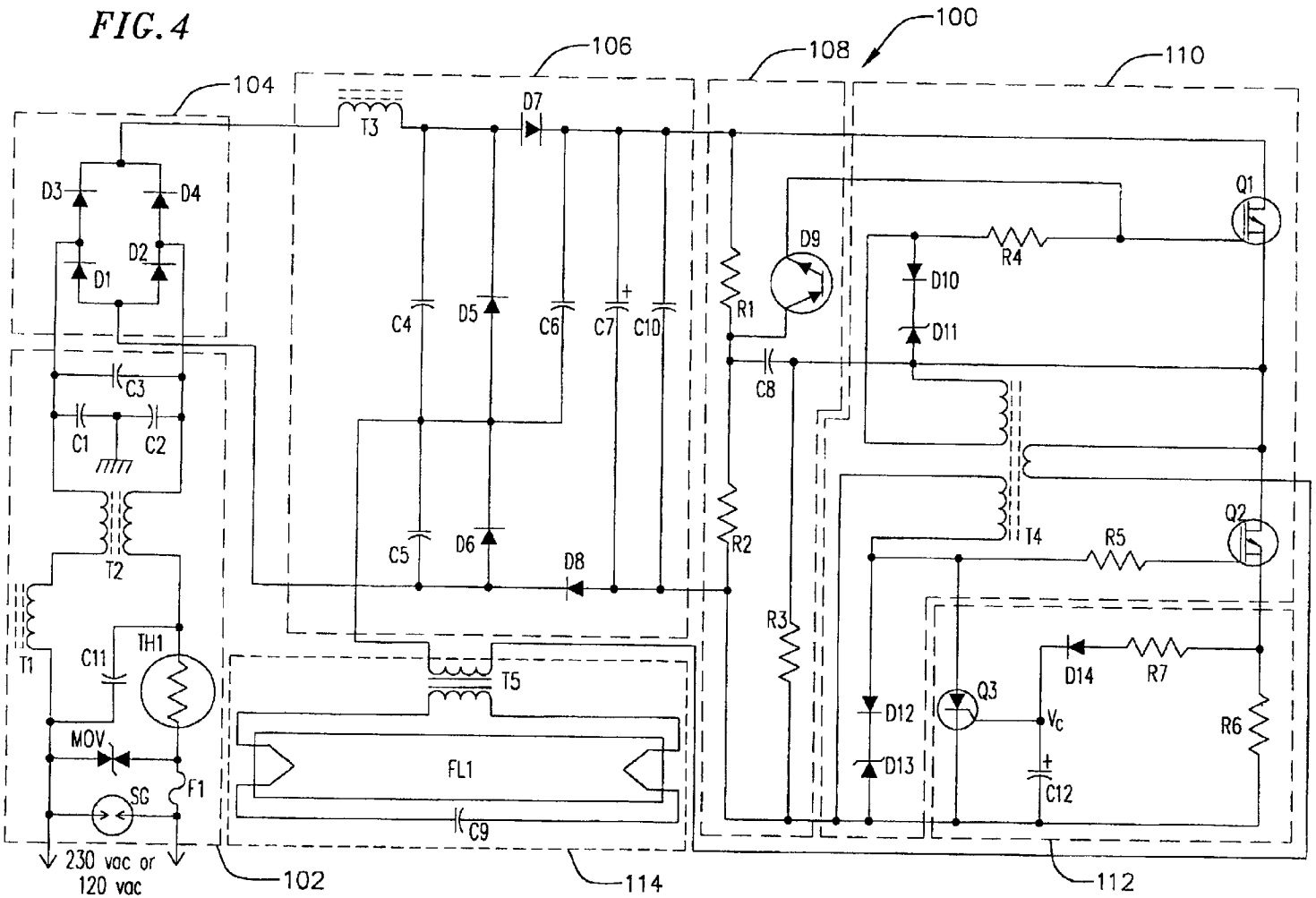
FIG. 4 is a schematic diagram of a ballast as per yet another aspect of the invention.

Referring now to FIG. 4, a component-level schematic diagram of the ballast 100 of the invention is shown. Although component-wise the ballast 100 is shown to be an integrated unit, which is the preferred manner of manufacturing it, the components may be grouped into the different functional blocks described in FIG. 2, namely the line-voltage filtering and circuit protection 102, the rectifier 104, the power factor correction and harmonic attenuation 106, the inverter starter circuit 108, the inverter or oscillator 110 and the ballast protection circuit 112. As shown in FIG. 3, the ballast is coupled to a fluorescent lamp circuit 114.

The line-voltage filtering and circuit protection portion 102 of the preferred form of the ballast 100 comprises an input, a spark gap protection device (SG), a fuse (Fi), a metallic oxide varister (MOV), a thermistor (TH1), chokes (T1–2), and capacitors (C1–3 and C11). The spark gap protection device (SG) is connected across the incoming line-voltage (120 or 230 vac) and provides protection to the ballast 100 against excessive voltage spikes that may be present in the line-voltage. Specifically, if an excessive voltage spike is present in the line-voltage, the spark gap protection device (SG) shorts to ground which prevents the spike from further propagating into the ballast circuit, which can cause damages to its components. The fuse (F1) is connected in series with the line-voltage to prevent excessive current into the ballast circuit, as it is conventionally known.

The metallic oxide varister (MOV) of the line-voltage filtering and circuit protection 102 of the ballast 100 is connected across the line-voltage (120 or 230 vac) and provides protection to the ballast circuitry against transients that may be present in the line-voltage. The negative-temperature coefficient thermistor (TH1) is connected in series with the line-voltage and provides protection to the ballast circuitry against start-up surges.

Specifically, during start-up conditions when thermistor (TH1) is at ambient temperature, it exhibits a resistance of about 50 Ohms. After the temperature of the thermistor (TH1) has increase after start-up, the thermistor exhibits a resistance of about 1 to 2 Ohms. The relatively large resistance of the thermistor (TH1) at start-up conditions provides protection to the ballast circuitry against start-up current surges.

The capacitor C11 connected across the line-voltage (120 or 230 vac) and the choke (T1) connected in series with the line-voltage provides filtering out or damping of noise present in the line-voltage, such as high-frequency noise, from propagating into the ballast circuitry. In addition, capacitor (C11) and choke (T1) also provides filtering out or damping of noise created by the ballast circuitry so that the noise does not propagate to the line-voltage. Choke T2 is a common mode choke for filtering of common mode noise generated by the ballast circuit; that is, it isolates the line-voltage, noise-wise, from the internal circuitry of the ballast 100. Capacitors C1 and C2 are provided for filtering out of common mode noise and C3 is provided for filtering out differential line noise.

The output of the line-voltage filtering and circuit protection 102 is taken across capacitor C3 and provides a filtered line-voltage to the rectifier circuit 100 of the ballast 100, as shown in FIG. 3. The rectifier circuit 100 is preferably a conventional full-wave rectifier comprised of diodes D1–4 connected in a conventional rectifying bridge manner. The diodes D1–4 should be chosen so that it can handle the line-voltage that is applied to it, as it is conventionally done. Although a full-wave rectifier is preferred, it shall be understood that other rectifying configurations may be used, such as for example, a half-wave rectifier or the like.

The output of the rectifier circuit 100 which provides a line-voltage at twice the frequency, in this case 120 Hz, is coupled to a power factor correction and harmonic attenuation portion 106 of the ballast. The power factor correction and harmonic attenuation 106 comprises a choke (T3), capacitors (C4–C7, and C10) and diodes (D5–D8). As the name suggests, the power correction and harmonic attenuation 106 increases the power factor correction as seen by the line-voltage received in order to increase the efficient use of the real power. In the preferred embodiment, a power factor correction of about 0.98 has been achieved. Also as the name suggests, the power correction and harmonic attenuation 106 provides for filtering out of the line-voltage harmonics. Specifically, capacitor C7 provides for lower-frequency harmonic and noise filtering and capacitor C10 provides for higher-frequency harmonic and noise filtering. In the preferred embodiment, the capacitor C10 is preferably a metallized polypropylene (MPP), which is particularly useful for high-frequency filtering. Also, in the preferred embodiment, a power harmonic distortion of about 10 percent has been achieved.

The output of the power correction and harmonic attenuation portion 106 of the ballast 100 taken across capacitor C10 provides a filtered DC voltage to the inverter starter circuit 108, the inverter 110 and the ballast protection circuit 112 for use in performing their functions. The inverter starter circuit 108 includes resistors R1–3, capacitor C8 and diac D9. As discussed above, the purpose of the inverter starter circuit 108 is to sense whether the inverter 110 is generating the lamp drive current, and to cause the inverter to start generating the lamp drive current if it senses that the inverter is off.

In operation, during start-up condition when the inverter 100 is off, the filtered DC voltage applied to capacitor C8 and resistor R3 by way of voltage-divider resistors R1 and R2, causes the capacitor to charge up to a specific voltage. This specific voltage is also applied across to the diac D9. When this voltage exceeds a certain level depending on the characteristic of the diac D9, the diac begins conducting for a short time. This action provides a voltage pulse to transistor Q1 of the inverter 110, which starts the inverter oscillating. During oscillation of the inverter, the apparent voltage across the diac is relatively small. If the inverter 110 ceases to oscillate, the voltage across the diac D9 increases, and thereby causes the diac to again conduct for a brief time. This action sends another voltage pulse to transistor Q1 for attempting to re-start the oscillation of the inverter 110. Although the inverter starter circuit 108 is shown connected to the gate of transistor Q1, it shall be understood that it can be configured to perform the inverter starting function by way of the base of transistor Q2.

As discussed earlier, the inverter 110 generates the lamp drive current for causing the continuous illumination of the fluorescent lamp 118. Preferably, the inverter 110 is an oscillating circuit comprising a pair of series-connected transistors Q1 and Q2 configured in a push-pull manner. The inverter 110 further includes a feedback transformer T4 having a primary winding coupled to the output of the inverter (the output of the inverter being the electrically-connected source (S) of transistor Q1 and drain (D) of transistor Q2). The feedback transformer T4 also includes a pair of secondary windings that are wound in opposite directions so that their respective voltages are 180 degrees out-of-phase. The inverter 110 further includes a pair of resistors R4 and R5 connected to the gates of transistors Q1 and Q2, respectively, for optimally tuning the inverter 110 by adjusting the phase of the current applied to the gates of the transistors. The resistors R4 and R5 also help in preventing transistors Q1 and Q2 to go into an oscillatory mode. Associated with each transistor in the inverter 110 are diodes (D11 for Q1 and D12 for Q2) and Zener diodes (D11 for Q1 and D13 for Q2) connected in series across respective secondary windings of the feedback transformer T4. The purpose of the series-connected diode and Zener diode is to limit the voltage applied to the gate of each transistor for protection of the gates. The Zener diodes clamp the gate voltage if it exceeds a certain level depending on the threshold voltage of the Zeners.

In operation, during start-up conditions or other conditions where the inverter 110 is off, that is both transistors Q1 and Q2 are off, the inverter starter circuit 108 provides a voltage pulse to transistor Q1 which allows it to conduct current between its drain (D) and source (S). The primary winding of the feedback transformer T4 senses this rise in drain current of transistor Q1 and induces an voltages on its respective secondary windings. The voltage induced in the secondary winding that is coupled to the gate of transistor Q2 is relatively high, which forces transistor Q2 to conduct. The voltage induced in the secondary winding that is coupled to the gate of transistor Q1 is relatively small, which forces transistor Q2 to stop conducting. Now the drain current of Q2 rises which causes the feedback transformer T4 to induce a voltage in the secondary winding associated with transistor Q1 that causes it to conduct, and induces another voltage in the secondary winding associated with transistor Q2 that causes it to stop conducting. This process is repeated to produce a lamp drive current that oscillates. In the preferred embodiment, the transistors Q1 and Q2 should be configured so that they do not operate in their linear region. In other words, they should be operated in either their full-conducting or non-conducting modes.

The output of the inverter 110 is connected in series with the primary winding of transformer T5 of the fluorescent lamp circuit 114. Therefore, the lamp drive current generated by the inverter 110 is coupled to the fluorescent lamp FL1 by way of transformer T5. Transformer T5 serves at least a couple of purposes. First, it provides isolation between the inverter 110 and the fluorescent lamp FL1. It also serves as an impedance matching device for matching the impedance of the output of inverter 110 with the impedance of the fluorescent lamp FL1. The secondary of transformer T5 is connected across the fluorescent lamp FL1 for applying the lamp drive current thereto by way of the lamp filaments 120*a–b*.

As discussed earlier, there may be situations where the fluorescent lamp FL1 operates at abnormal conditions. These abnormal conditions, for example, can be due to aging or lamp deactivation. During these abnormal lamp conditions, the resistance of the lamp FL1 substantially increases due to the lack of current conduction therethrough. As a result, the load as seen by the output of the inverter 110 is essentially a high-Q LC resonant circuit having relatively low impedance. This low impedance load causes the inverter to generate a relatively large current, which causes heat to build up in transistors Q1 and Q2, and possibly other components, which may damage these devices.

Therefore, to protect the ballast 100, and especially the inverter 110 from damage due to abnormal lamp conditions, the ballast 100 includes a ballast protection circuit 112. As discussed earlier, functionally, the ballast protection circuit 112 monitors or senses the current of the lamp drive current, and if it determines that the current exceeds a predetermined level, it causes the inverter 110 to stop generating the lamp drive current; thereby, preventing the transistors Q1 and Q2 or other components from excessive current that may damage them.

Specifically, the preferred embodiment of the ballast protection circuit 112 includes a sensing circuit and a response or trigger circuit. In the preferred embodiment, the trigger takes the form of silicon controlled rectifier (SCR Q3) or similar device. The sensing circuit is preferably R6, and the protection –N circuit may also include delay components such as one or more of diode D14, resistors R7, and capacitor C12. The resistor R6 is connected in series with transistor Q2, and accordingly, develops a voltage across it that is proportional or directly related to the lamp drive current. Resistor R6 is therefore termed a current sensing resistor and the voltage across it is a current sensing voltage. A series path comprising of resistor R7, diode D14 and capacitor C12 is connected across the current sensing resistor R6 which provides the current sense voltage to the control terminal of the SCR Q3. The cathode and anode of the SCR Q3 is connected across the gate (G) and the source (S) of Q2 by way of resistors R5 and R6.

In operation, during normal operations of the ballast 100 where no abnormal lamp conditions are present, the current sense voltage across the current sense resistor R6 is below the trigger level of the SCR Q3. In other words, the resistance of the current sensing resistor R6 is such that during normal levels of the lamp drive current, the current sense voltage developed across the current sense resistor R6 is lower than the trigger level of the SCR Q3 (ignoring the 0.7 Volt drop across the diode D14, for the purpose of this explanation). When abnormal lamp conditions occur, the lamp drive current may increase to a level that results in a current sense voltage applied to the control terminal of the SCR Q3 that exceeds its trigger level. In other words, the resistance of the current sensing resistor R6 is such that during abnormal levels of the lamp drive current, the current sense voltage developed across the current sense resistor R6 is above the trigger level of the SCR Q3.

When the trigger voltage of the SCR Q3 is exceeded during abnormal lamp conditions, the SCR Q3 conducts, and consequently, forces down the voltage applied to the gate of transistors Q2, or alternatively, shunts the gate of transistor Q2. As a result, transistor Q2 ceases to conduct, which consequently stops the inverter 110 from oscillating. Although the ballast protection circuit 112 is set up for causing transistor Q2 to cease conducting when abnormal lamp conditions occur, it shall be understood that the ballast protection circuit 112 can be configured in a similar manner to cause transistor Q1 from conducting when abnormal lamp conditions occur. There may be even situations where it is desirable to provide a ballast protection circuit 112 for each of the transistors Q1 and Q2.

The capacitor C12 of the ballast protection circuit 112 is used for affecting the timing of when the ballast protection circuit is activated after an abnormal lamp condition occurs. More specifically, during an abnormal lamp condition, the current sense voltage across the current sense resistor R6 will increase due to the increase in the lamp drive current, as explained above. The control input of the SCR Q3 will not sense this increase in the current sense voltage immediately, since the capacitor C12 will take some time (time-constant) to charge up. When the capacitor C12 charges up to the trigger voltage of the SCR Q3, the SCR Q3 will conduct and cause the inverter 110 to shut off. This delay in the activation of the ballast protection circuit 112 after an abnormal lamp condition occurs can be termed herein as the "protection activation delay."

The protection activation delay of the ballast protection circuit 112 is useful during start-up conditions. During start-up conditions, or often termed a "cold lamp condition", current conduction within the fluorescent lamp FL1 does not occur immediately, and therefore, the lamp FL1 looks like a high-Q low impedance load to the output of the ballast 100. As a result, the ballast 100, upon start-up, will produce a relatively large current in order to cause ionization of the lamp gas so that current conduction can occur within the lamp. To the ballast protection circuit 112, this initial in-rush of current to the lamp FL1, looks like an abnormal lamp condition since the current sense voltage across the current sense resistor R6 will be of sufficient size to cause the ballast protection circuit to activate. Thus, without the protection activation delay, the ballast protection circuit 112 might otherwise always activate on start-up condition, and cause the inverter 110 to shut-off on start-up.

Because of the protection activation delay due to capacitor C12, the ballast protection circuit 112 allows sufficient time for normal current conduction within the fluorescent lamp FL1 to occur before the ballast protection circuit is activated. Therefore, there is no problem of the inverter 110 being shut off permanently before the fluorescent lamp FL1 is illuminated. Generally, it only takes a few cycles of the lamp drive current to cause normal current conduction within the fluorescent lamp FL1. Therefore, the protection activation delay of the ballast protection circuit 112 should be sufficient to allow normal current conduction of the lamp FL1. In the preferred embodiment, the protection activation delay is approximately 4 milli-seconds, whereas the frequency of the lamp drive current is around 42 to 62 KHz, which provides for about a little over 10 periods of the lamp drive current to occur before the ballast protection circuit 112 activates.

In addition, it is also desirable for the ballast protection circuit 112 not to activate immediately when the current sense voltage indicates an abnormal lamp condition. This is because there may be times when fast transients, surges or spikes present at the output of the inverter 110 cause the current sense voltage to indicate that an abnormal lamp condition has occurred. It is not necessarily desirable for the ballast protection circuit 112 to activate and cause the inverter 110 to shut-off each time there is a fast transient, surge or spike at the output of the inverter 110.

The capacitor C12 of the ballast protection circuit 112 also provides an additional timing function useful for the ballast 100. Specifically, after an abnormal lamp condition occurs which causes the ballast protection circuit 112 to activate and shut-off the inverter 110, the lamp drive current decreases to nil after the ballast protection circuit 112 causes the inverter 110 to shut off. This results in a current sense voltage across current sense resistor R6 that decreases to nil. Therefore, without the capacitor C12, the voltage applied to the control terminal of the SCR Q3 could also decrease immediately to nil, which could de-activate the ballast protection circuit 112. In the meantime, the inverter starter circuit 108, after shut-off of the inverter 110, attempts to re-start the inverter 110 by providing voltage pulses to the gate of the transistor Q1, as explained above. Therefore, if capacitor C12 were not present, the inverter 110 could almost start immediately or a short time after an abnormal lamp condition has activated the ballast protection circuit. Thus, it may be desirable not to restart the inverter 110 immediately after shut-off from an abnormal lamp condition, to allow some time for the abnormal lamp condition or the effects thereof to possibly dissipate.

Thus, the capacitor C12 of the ballast protection circuit 112 allows for the voltage at the control terminal of the SCR Q3 to slowly dissipate to keep the ballast protection circuit activated a pre-determined time so that the inverter 110 does not immediately re-start. This allows for possibly the abnormal lamp condition to dissipate, if that is possible. The diode D14 prevents voltage on capacitor C12 to dissipate through R6 and R7 in order to provide a sufficient delay in the de-activation of the ballast protection circuit. This delay can be termed herein as the "protection de-activation delay."

Figure 5:
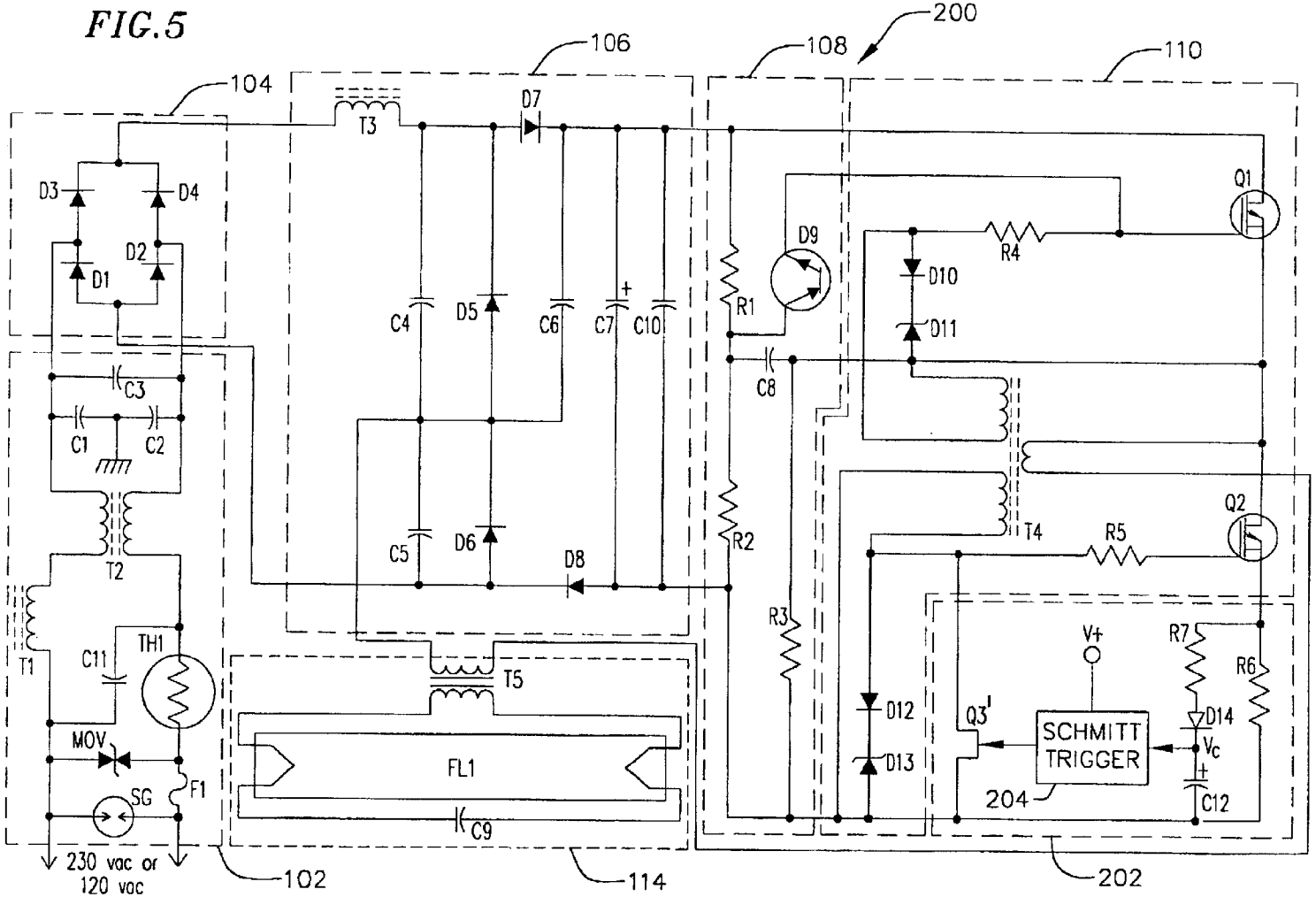
FIG. 5 is a schematic diagram of a ballast as per even another aspect of the invention.

Referring now to FIG. 5, a schematic diagram of a ballast circuit 200 is shown as per another aspect of the invention. The ballast 200 is similar to that of ballast 100, and therefore, similar elements will be denoted with the same reference numbers. Ballast 200 includes a ballast protection circuit 202 that is a variant of ballast protection circuit 112. The ballast protection circuit 200 includes a current sense resistor R6 which produces a current sense voltage across it that is proportional or related to the lamp drive current of the output of the ballast 100. Circuit 200 further includes a series-path connected across the current sense resistor R6 comprised of resistor R7, diode D14, and capacitor C12. All these components, namely resistors R6 and R7, diode D14, and capacitor C12 serve substantially the same functions as the same components of the ballast protection circuit 112 of FIG. 3. Therefore, attention is directed to the detailed functional discussion of FIG. 3 above.

The ballast protection circuit 202 differs from protection circuit 112 in that instead of the SCR Q3 used for shunting the gate of transistor Q2 in order to shut-off the inverter 110, it uses a conventional metal oxide field effect transistor (MOSFET) Q3' to perform a shunting function. The concern with the use of MOSFET Q3' is that it tends to go into its linear operation if the voltage at its gate is not above its trigger level for given circuit conditions. If MOSFET Q3' operates in the linear region, it may cause transistors Q1 and Q2 also to operate in the linear regions, which would cause an undesirable operation of the inverter 110.

Therefore, in order to prevent the MOSFET Q3' to operate in its linear region, a Schmitt trigger 204 is provided having an input coupled to the capacitor C12 for receiving therefrom the current sense voltage $V_C$, and an output coupled to the gate of the MOSFET Q3'. In operation, when the current sense voltage $V_C$ is below the threshold voltage of the Schmitt trigger 204 (that is, under normal lamp drive current conditions or ballast off condition), the Schmitt trigger outputs about a zero voltage to the gate of the MOSFET Q3'. Therefore, the MOSFET Q3' does not conduct, and consequently, the ballast protection circuit 202 remains de-activated. When an abnormal lamp condition occurs, the current sense voltage $V_C$ rises to above the threshold level of the Schmitt trigger 204. When this occurs, the Schmitt trigger 204 produces an output voltage that is applied to the gate of the MOSFET Q3' that causes it to go into saturation. At saturation, the MOSFET Q3' fully conducts and shunts the gate of transistor Q2, thereby shutting-off the inverter 110. Thus, the ballast protection circuit 202 is activated.

Figure 6:
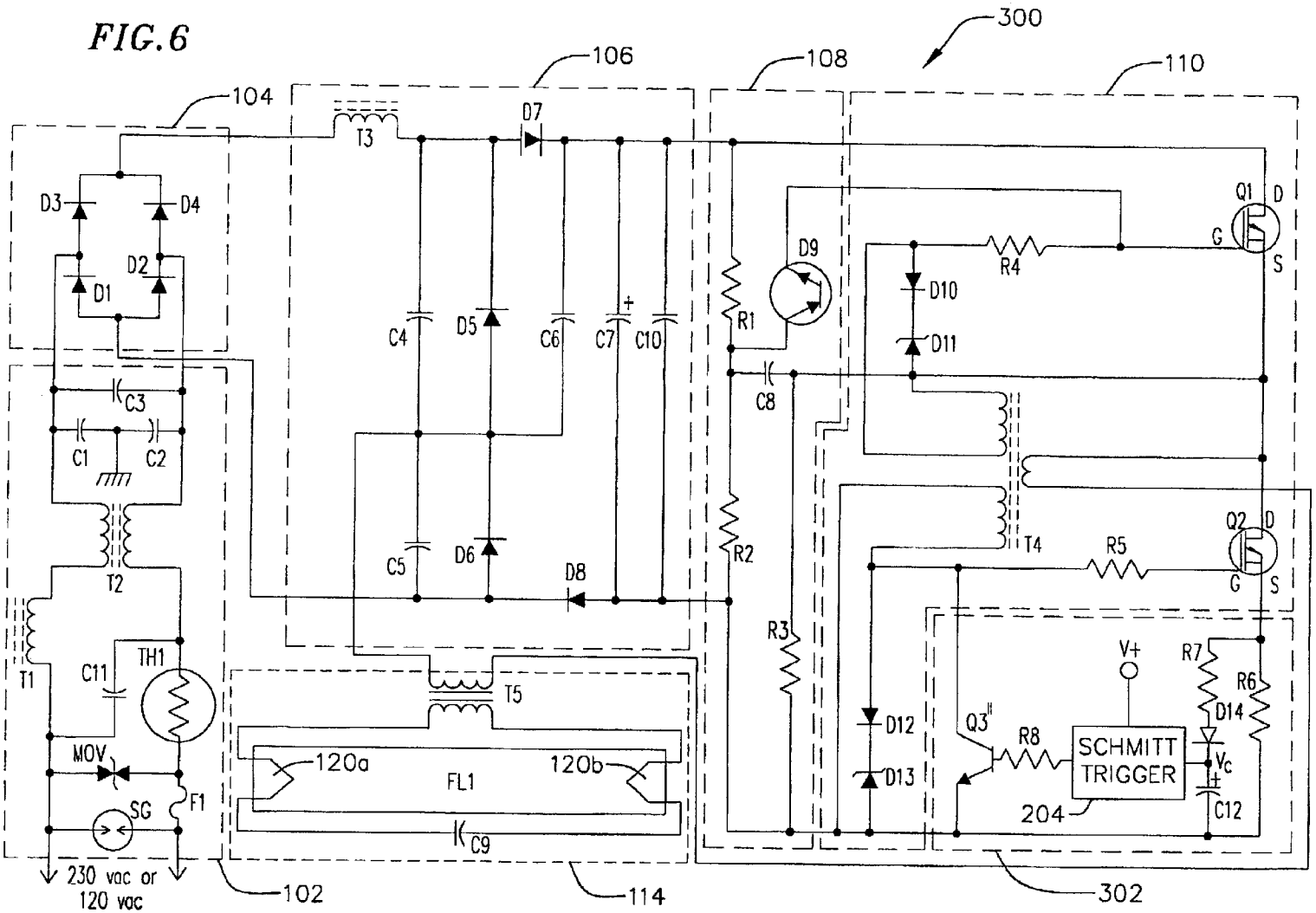
FIG. 6 is a schematic diagram of a ballast as per still another aspect of the invention.

Referring now to FIG. 6, a schematic diagram of a ballast 300 as per yet another embodiment of the invention is shown. The ballast 300 is similar to ballast 200, but it includes a ballast protection circuit 302 that is a variant of ballast protection circuit 202. Instead of using a MOSFET Q3' for achieving the shunting of the transistor Q2 of the inverter 110 for the purpose of shutting-off the inverter, a bipolar transistor Q3" is used to perform the same function. A resistor R8 is provided between the output of the Schmitt trigger 204 and the base of the bipolar transistor Q3".

The operation of the ballast protection circuit 302 functions similar to that of protection circuit 202 in that a current sense voltage $V_C$ below the threshold level of the Schmitt trigger 204 causes the Schmitt trigger to output a voltage near zero. This zero or low voltage (preferably below 0.7 Volts) is applied to the base of the bipolar transistor Q3" which fails to cause the transistor Q3" to conduct. When the current sense voltage $V_C$ is above the threshold level of the Schmitt trigger 204, it causes the Schmitt trigger 204 to output a voltage sufficient to cause the bipolar transistor Q3" to go into saturation. At saturation, the bipolar transistor Q3" fully conducts and shunts the gate of transistor Q2, thereby shutting-off the inverter 110. Thus, the ballast protection circuit 302 is activated.

There may be other devices, other than SCR Q3, the MOSFET Q3', and the bipolar transistor Q3" that can be used for shunting the transistor Q2 of the inverter 110, or more generally, for causing the inverter 110 to stop generating the lamp drive current or otherwise change the output to the lamp. Such devices would use a controllable conduction path that is responsive to the current sense voltage developed across the current sense resistor R6. For example, one other device is an opto-isolator. The advantage of the opto-isolator is that it can be implemented without a ground reference. Therefore, it may be employed in different areas of the ballast for use in sensing an abnormal lamp drive current.

The advantage of the ballast protection circuits 112, 202 and 302 of the invention is that they require relatively few parts. Whereas the prior art ballast protection circuits are more complex, including relatively large component count number, and more intricate manner of sensing an abnormal lamp condition. The relatively small part-count for the ballast protection circuits of the invention translates into a less expensive ballast because fewer parts and, accordingly, less labor, are required. From a time standpoint, fewer parts translates into less time to manufacture the ballast. In addition, fewer parts also translates to a statistically more reliable ballast.

Appendix A included herewith includes the preferred component specifications for the ballasts 100, 200 and 300 for two different types of lamps and for two different line voltages. More specifically, page 1 of Appendix A lists the preferred component specification of the ballasts for driving a 28 watt, T5 size fluorescent lamp (F28T5) for a line voltage of 120 vac. Page 2 of Appendix A lists the preferred component specification of the ballasts for driving a 28 watt, T5 size fluorescent lamp (F28T5) for a line voltage of 230 vac. Page 3 of Appendix A lists the preferred component specification of the ballasts for driving a 32 watt, T8 size fluorescent lamp (F32T8) for a line voltage of 120 vac. And, page 4 of Appendix A lists the preferred component specification for a 32 watt, T8 size fluorescent lamp (F32T8) for a line voltage of 230 vac.

Figure 7:
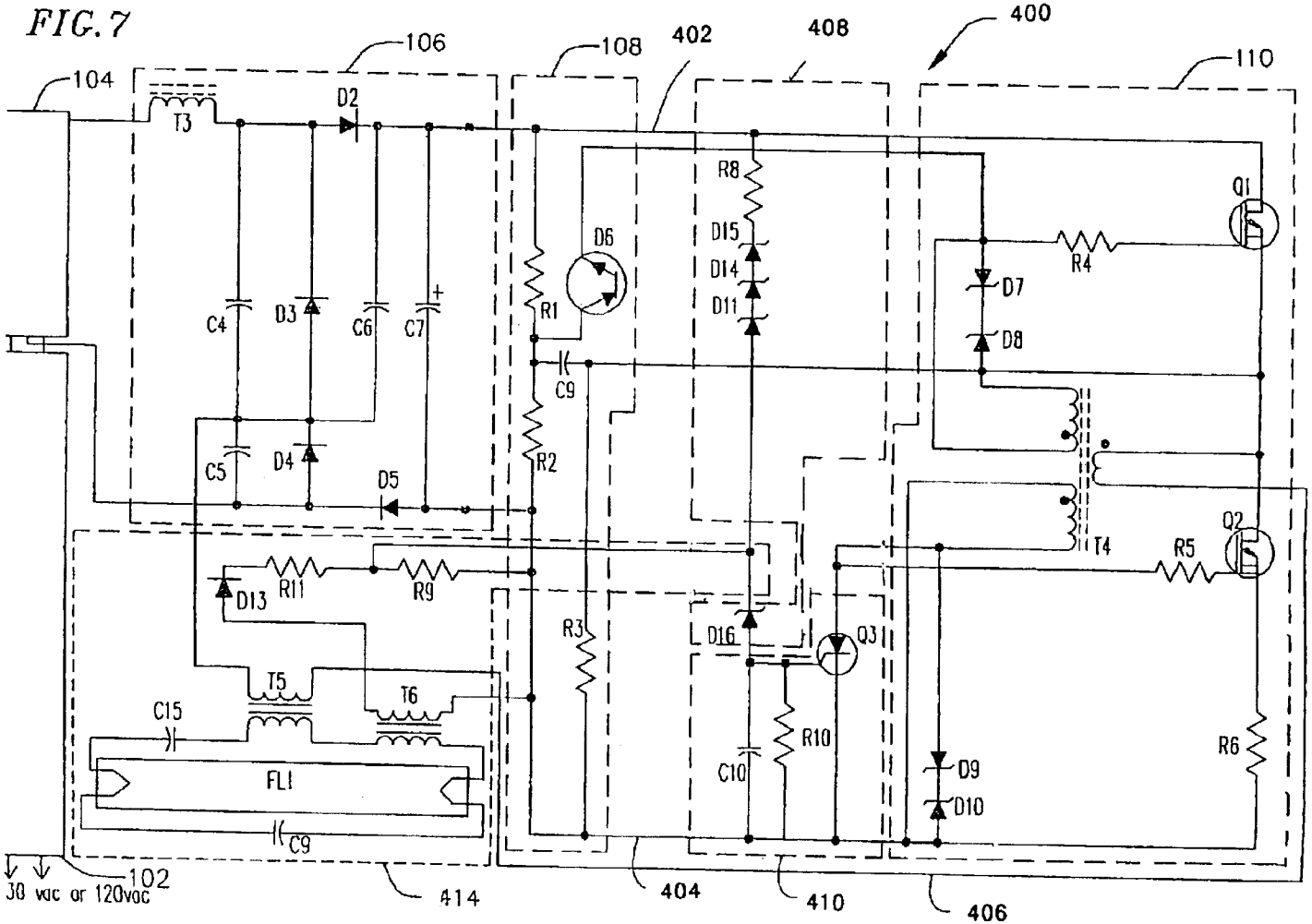
FIG. 7 is a schematic of a ballast in accordance with another aspect of one of the present inventions.

Referring now to FIG. 7, a component-level schematic diagram of the ballast 400 according to one aspect of one of the present inventions is shown. The ballast according to the circuit shown in FIG. 7 can be used to prevent excessive electronic ballast output voltage, and/or input current draw. The circuit can detect an out of tolerance load condition through a supply voltage feedback. The ballast includes a line-voltage filtering and protection circuit 102 and a rectifier 104. A power factor correction and harmonic attenuation circuit 106, inverter starter circuit 108 and inverter or oscillator circuit 110 are included and have functions similar to those described previously with respect to other examples of the inventions. The general circuits are similar to those described above, but the individual components making up those circuits are not necessarily identical in FIG. 7 to components in the same positions in FIGS. 4–6. Components in the same positions generally have the same characteristics and functions, but the components in FIG. 7 have the values set forth in Table 1 below. Those individual components that are essentially the same as previously described will not be discussed separately, while components that are different from those shown in FIGS. 4–6 are discussed more fully below.

In the ballast circuit 400 shown in FIG. 7, the rectifier circuit 104 provides a DC output to a high voltage line or supply bus 402 and a baseline 404. The oscillator circuit 110 is coupled between the supply bus 402 and the baseline 404 and includes an output circuit 406 for carrying a lamp drive current for driving the electric discharge lamp FL1 through transformer T5. A ballast protection circuit includes a detection circuit 408 coupled between the supply line 402 and the baseline 404. The detection circuit detects when the voltage on the supply line exceeds a given threshold. The ballast protection circuit also preferably includes a shut-off device or response circuit 410, preferably coupled to the detection circuit 408 and to the lamp drive circuit 110. The response circuit 410 reduces the lamp drive current produced by the lamp drive circuit and preferably prevents the lamp drive circuit from producing a current when voltage on the supply line 402 exceeds the selected threshold.

In one embodiment of the inventions shown in FIG. 7, the detection circuit includes one or more voltage threshold devices for example a plurality of Zener diodes D11, D14 and D15 coupled to the supply line 402 through resistor R8. The series of Zener diodes detects excess voltage conditions on the supply bus 402 input to the ballast switching elements Q1 and Q2. The Zener diodes can be selected so as to produce the desired threshold, and in one embodiment are selected to produce a threshold at approximately two times the normal operating voltage on supply line 402. In one embodiment, where the normal operating voltage on supply line 402 is about 160 volts, the threshold may be about 200 to 220 volts, and preferably about 212 volts, between about 1.2 and 1.4 times the operating voltage and preferably about 1.3 times, given the load and input conditions described herein. If the threshold voltage is too high, an over-voltage might not trigger the circuit at the desired point to minimize damage to the circuit. The detection circuit 408 may also include an additional, low-value Zener diode D16 coupled to the response circuit 410 to provide a lower threshold for use by another protection circuit for example circuit 414 described more fully below.

The response circuit 410 may be essentially the same as the trigger or response circuit previously described, for example a current conduction device such as the silicon control rectifier Q3 or a similar device. The response circuit may also include a delay circuit such as capacitor C10 and resistor R10, or the delay circuit may be included in the detection circuit, for example. In the embodiment shown in FIG. 7, when a voltage exceeds the threshold of the Zener diodes, the SCR is triggered to short circuit the gate of transistor Q2 to shut-off the inverter. The inverter remains off until the starter circuit 108 initiates conduction in the transistors Q1 and Q2. If oscillation begins again, the ballast will shutdown again if an improper load condition is still detected.

Circuit 414 may also include a detection circuit. Circuit 414 shows a single lamp FL1, but it should be understood that additional lamps can be included with their own detection circuits, both lamps operating off of current induced through the transformer T5. In the embodiment of circuit 414 shown in FIG. 7, an additional detection circuit includes transformer T6 in the form of a series inductor having a feedback winding coupled to a diode D13 in series with a voltage divider composed of resistor R11 and resistor R9, coupled to the baseline 404. The other side of the inductor T6 is coupled to the baseline 404.

The detection circuit in circuit 414 detects a short or lowered impedance in the primary of T5, indicating an abnormal lamp condition, such as mis-connection, depleted lamp gas, or the like. The current induced in the feedback winding of T6 is rectified through the diode D13 and a voltage taken off the divider network R11 and R9 and applied between the diodes D16 and D11. When the voltage exceeds the breakdown voltage of the Zener diode D16, the SCR Q3 is triggered after the delay imposed by the delay circuit of capacitor C10 and resistor R10. The inverter is then shutdown.

The detection circuit in circuit 114 may also influence the detection circuit 408. If any effective short is detected in one or more lamps, the energy stored in the inductor(s) T6 is sent back to the transformer T5 from the secondary to the primary and adds to the charge on capacitor C7. If the charge is high enough, the voltage on the supply line may rise significantly above normal, possibly sufficient to trigger the response circuit 410 through the diodes D11, D14 and D15.

A table of component values for the exemplary circuit of FIG. 7 is set forth below for a 120 volt, 40 watt T8 fluorescent lamp. Other components could also be used.

TABLE I

Component Specifications for FIG. 7 Ballast, 120v F40T8 HO Lamp

| DESIGNATION | QTY | SPECIFICATION | DESCRIPTION |
|---|---|---|---|
| T1 | 1 | 0.5 mHy, 1 A, 14 mm Drum core | INDUCTOR |
| T2 | 1 | 5.4 mHy, 1 A | CM LINE CHOKE |
| T3 | 1 | 1.0 m Hy, EI28, 85t 0.16 × 10 | INDUCTOR |
| T4 | 1 | 10 mm Drum core, Ns1-125t 0.20, Ns2-125t 0.20, Np-6.5t 0.67, Ns1 to Q1<br>Ns1 wound first on the core | FEED BACK XFORMER |
| T5 | 1 | PQ32/20, Np-22.5t 0.14 × 16, Ns-50t 0.16 × 10 (No Gap) | XFORMER |
| T6, T7 | 2 | EI28, 120t 0.1 × 14 (gap for 2.0 mHy)<br>Ns-2t 0.28 | INDUCTOR |
| D1 | 1 | 4A, 800 V Bridge | RECTIFIERS |
| D2, D5 | 2 | 400 V, 6A, 75 nS | FAST RECTIFIERS |
| D3, D4 | 2 | UF5404 | FAST RECTIFIERS |
| D6 | 1 | DB4 | DIAC |
| D7, D9 | 2 | 1N4745A 16 V 1 W | ZENER DIODE |
| D8, D10 | 2 | 1N4735A 6.2 V 1 W | ZENER DIODE |
| D11, D14 | 2 | 100 V 500 mW 5% | ZENER DIODE |
| D12, D13 | 2 | 1N914B | DIODE |

TABLE I-continued

Component Specifications for FIG. 7 Ballast, 120v F40T8 HO Lamp

| DESIGNATION | QTY | SPECIFICATION | DESCRIPTION |
|---|---|---|---|
| D15 | 1 | 1N5250B 20 V 500 mW 5% | ZENER DIODE |
| D16 | 1 | 1N5239B 12 V 500 mW 5% | ZENER DIODE |
| Q1, Q2 | 2 | 1RF5644 | MOSFET |
| Q3 | 1 | TCR22 or MCR100-6 | SCR |
| C1, C2 | 2 | 0.001 uF 400 Vac UL listed Y capacitor | CERAMIC CAP |
| C3 | 1 | 0.22 uF 400 VDC 10% | MPE FILM CAP |
| C4, C5 | 2 | 100 nF 250 VDC 5% | MPP FILM CAP |
| C6 | 1 | 15 nF 400 VDC 5% | MPP FILM CAP |
| C7 | 1 | 4.7 uF 250 VDC 10% | MPE FILM CAP |
| C9 | 1 | 0.10 uF 100 VDC 10% | MPE FILM CAP |
| C10 | 1 | 220 uF 6.3 VDC 105 deg C. | ELEC CAP |
| C11, C12 | 2 | 5.6 nF 1k V 5% | MPP FILM CAP |
| C13 | 1 | 0.10 uF 400 VDC 10% | MPE FILM CAP |
| C15 | 1 | 0.47 uF 100 Vdc 10% | PPY FILM CAP |
| R1, R2, R3 | 3 | 1M 1/4 W 5% | RESISTOR |
| R4, R5 | 2 | 27 ohm 1/4 W 5% | RESISTOR |
| R6 | 1 | 0.10 ohm 1 W | RESISTOR |
| R8 | 1 | 22k 1/2 W 5% | RESISTOR |
| R9 | 1 | 100k 1/4 W 5% | RESISTOR |
| R10 | | 750 ohm 1/4 W 5% | RESISTOR |
| R11 | 1 | 47 ohm 1/4 W 5% | RESISTOR |

Although the present invention has been described in detail regarding the exemplary embodiments and drawings thereof, it should be apparent to those skilled in the art that various adaptations and modifications of the present invention may be accomplished without departing from the spirit and scope of the invention. Accordingly, the invention is not limited to the precise embodiments shown in the drawings and described in detail in hereinabove.

What is claimed is:

1. A ballast circuit comprising:

a DC input circuit having a high voltage line and a base line;

a lamp drive circuit coupled between the high voltage line and the base line;

an output circuit coupled to the lamp drive circuit for producing a lamp drive current used for driving an electric discharge lamp, the output circuit includes an inverter comprising first and second field effect transistors in a push-pull configuration including a feedback device for causing the inverter to generate an oscillating lamp drive current; and a ballast protection circuit for protecting the lamp drive circuit, comprising:

a detection circuit coupled between the high voltage line and the base line configured to detect when a voltage on the high voltage line exceeds a threshold, and a shutoff device coupled to the detection circuit and to the lamp drive circuit for preventing the lamp drive circuit from producing the lamp drive current when the detected voltage on the high voltage line exceeds the threshold.

2. The ballast circuit of claim 1 wherein the shutoff device is one of a silicon control rectifier, a MOSFET, a bipolar transistor and an opto-isolator.

3. The ballast circuit of claim 1 wherein at least one of the ballast protection circuit and the shutoff device includes a delay circuit.

4. The ballast circuit of claim 3 wherein the delay circuit includes a capacitor coupled to a resistor.

5. The ballast circuit of claim 1 wherein the shutoff device includes a device having a controllable conduction path coupled to the gate and source of the first field effect transistor.

6. The ballast circuit of claim 5 wherein the shutoff device is one of a silicon controlled rectifier, bipolar transistor and a MOSFET.

7. The ballast circuit of claim 1 further including an inverter starter circuit for producing a starting pulse that is applied to the gate of the first transistor for causing the inverter to start producing the oscillating lamp drive current.

8. The ballast circuit of claim 1 wherein the ballast circuit further includes a full wave rectifier coupled to the DC input circuit at the high voltage line and the base line.

9. The ballast circuit of claim 1 wherein the lamp drive circuit includes an inverter circuit.

10. The ballast circuit of claim 9 wherein the inverter circuit includes transistors arranged in a push pull configuration.

11. The ballast circuit of claim 1 wherein the shut-off device includes an SCR.

12. The ballast circuit of claim 1 wherein the detection circuit is configured to detect when a voltage on the high voltage line exceeds a value equal to approximately twice the voltage on the high voltage line under normal operating conditions.

13. The ballast circuit of claim 1 wherein the detection circuit is configured to detect a voltage greater than 200 volts.

14. The ballast circuit of claim 1 wherein the detection circuit is configured to detect a voltage greater than 212 volts.

15. The ballast circuit of claim 1 wherein the shut-off device includes a component selected from a group of a silicon control rectifier, a bi-polar transistor, an opto-isolator and a MOSFET.

16. A method of protecting a ballast circuit having an inverter included in an output circuit from generating a lamp drive current that is excessive, comprising:

sensing an input voltage that varies as a function of an input to the ballast; and preventing the inverter from generating a lamp drive current if the sensed voltage exceeds a predetermined voltage by preventing a transistor in the inverter from conducting current wherein the output circuit includes the inverter comprising first and second field effect transistors in a push-pull configuration including a feedback device for causing the inverter to generate an oscillating lamp drive current.

17. The method of claim 16 further including a step of delaying the step of preventing for a predetermined time so that the starting of an electric discharge lamp does not prevent the ballast circuit from generating the lamp drive current.

18. The method of claim 16 wherein the step of preventing the inverter from generating the lamp drive current includes a step of shunting a gate voltage of the lamp drive current generating field effect transistor in order to prevent the operating of the transistor.

19. The method of claim 18, wherein the step of shunting the gate voltage of the field effect transistor includes using one of a silicon controlled rectifier, bipolar transistor, MOSFET and opto-isolator to perform the shunting.

20. A ballast circuit comprising:

an input circuit for receiving current from a current source;

an inverter for producing an alternating current for a load;

an output circuit for supplying power to an electric discharge lamp; and a ballast protection circuit configured between the input and the output circuits for protecting the ballast circuit from providing excessive power at the output circuit, the protection circuit including a lamp current sensing circuit for sensing a voltage in the load circuit, and a response circuit coupled to the current sensing circuit to prevent the inverter from oscillating and thus reduce the power to the output circuit when the sensed load current reaches a given level.

21. A ballast circuit comprising:

an input circuit for receiving power from a power source;

an output circuit for supplying drive current to an electric discharge lamp;

an oscillation circuit between the input circuit and the output circuit for creating an oscillating current for the output circuit to drive the electric discharge lamp; and a ballast protection circuit coupled to the input circuit for protecting the ballast circuit from excessive drive current being developed in the output circuit, the protection circuit including at least one diode and a trigger circuit coupled to the at least one diode for reducing the drive current in the output circuit when a voltage in the input circuit reaches a given level.

22. The ballast circuit of claim 21 wherein the oscillation circuit includes at least one transistor and wherein the trigger circuit is coupled to a gate of the at least one transistor.

23. The ballast circuit of claim 22 wherein the trigger circuit is coupled between the diode and the gate of the at least one transistor.

24. The ballast circuit of claim 23 wherein the ballast protection circuit includes at least a plurality of diodes coupled to the input circuit.

25. The ballast circuit of claim 23 wherein the trigger circuit includes a current conduction device coupled between the diode and the gate of the at least one transistor.

26. The ballast circuit of claim 25 wherein the trigger circuit includes a delay circuit.

27. The ballast circuit of claim 25 wherein the current conduction device is an SCR.

28. The ballast circuit of claim 27 wherein the oscillation circuit includes a pair of MOSFETs.

29. The ballast circuit of claim 28 wherein the SCR is coupled to a gate of one MOSFET and wherein the at least one diode is a plurality of diodes coupled between the input circuit and a gate of the SCR.

30. A ballast circuit comprising:

a DC input circuit;

a lamp drive circuit coupled to the DC input circuit;

an output circuit coupled to the lamp drive circuit for producing the lamp drive current used for driving an electric discharge lamp; and a ballast protection circuit for protecting the lamp drive circuit, including a detection circuit coupled to the DC input circuit and configured to detect when a voltage from the DC input circuit exceeds a threshold, and a shutoff device coupled to the detection circuit and to the lamp drive circuit for preventing the lamp drive circuit from producing a lamp drive current.

31. A ballast circuit comprising:

a DC input circuit having a high voltage line and a base line;

a lamp drive circuit coupled between the high voltage line and the base line, the lamp drive circuit includes an inverter circuit, the inverter circuit includes a pair of MOSFETs;

an output circuit coupled to the lamp drive circuit for producing a lamp drive current used for driving an electric discharge lamp; and a ballast protection circuit for protecting the lamp drive circuit, comprising:

a detection circuit coupled between the high voltage line and the base line configured to detect when a voltage on the high voltage line exceeds a threshold, and a shutoff device coupled to the detection circuit and to the lamp drive circuit for preventing the lamp drive circuit from producing the lamp drive current when the detected voltage on the high voltage line exceeds the threshold.

32. A ballast circuit comprising:

a DC input circuit having a high voltage line and a base line;

a lamp drive circuit coupled between the high voltage line and the base line;

an output circuit coupled to the lamp drive circuit for producing a lamp drive current used for driving an electric discharge lamp; and a ballast protection circuit for protecting the lamp drive circuit, comprising:

a detection circuit coupled between the high voltage line and the base line configured to detect when a voltage on the high voltage line exceeds a threshold, and a shutoff device coupled to the detection circuit and to the lamp drive circuit for preventing the lamp drive circuit from producing the lamp drive current when the detected voltage on the high voltage line exceeds the threshold, the shutoff device includes an SCR.

33. The ballast circuit of claim 32 further comprising a transistor in the lamp drive circuit having a gate and wherein the SCR is coupled to the gate of the transistor in the lamp drive circuit.

34. A ballast circuit comprising:

a DC input circuit having a high voltage line and a base line;

a lamp drive circuit coupled between the high voltage line and the base line;

an output circuit coupled to the lamp drive circuit for producing a lamp drive current used for driving an electric discharge lamp; and a ballast protection circuit for protecting the lamp drive circuit, comprising:

a detection circuit coupled between the high voltage line and the base line configured to detect when a voltage on the high voltage line exceeds a threshold, the detection circuit is configured to detect when a voltage on the high voltage line exceeds a value equal to approximately twice the voltage on the high voltage line under normal operating conditions, and a shutoff device coupled to the detection circuit and to the lamp drive circuit for preventing the lamp drive circuit from producing the lamp drive current when the detected voltage on the high voltage line exceeds the threshold.

35. A ballast circuit comprising:

a DC input circuit having a high voltage line and a base line;

a lamp drive circuit coupled between the high voltage line and the base line;

an output circuit coupled to the lamp drive circuit for producing a lamp drive current used for driving an electric discharge lamp; and a ballast protection circuit for protecting the lamp drive circuit, comprising:

a detection circuit coupled between the high voltage line and the base line configured to detect when a voltage on the high voltage line exceeds a threshold, the detection circuit includes a series of diodes, and a shutoff device coupled to the detection circuit and to the lamp drive circuit for preventing the lamp drive circuit from producing the lamp drive current when the detected voltage on the high voltage line exceeds the threshold.

36. The ballast circuit of claim 35 wherein a series of diodes are coupled between the high voltage line and a gate of a current conduction device.

37. The ballast circuit of claim 36 wherein the lamp drive circuit includes at least one transistor and wherein the current conduction device is coupled to a gate of the transistor.

38. The ballast circuit of claim 36 further comprising a delay circuit coupled to the gate of current conduction device.

39. The ballast circuit of claim 36 further comprising a capacitor coupled to the gate of the current conduction device.

40. A ballast circuit comprising:

a DC input circuit having a high voltage line and a base line;

a lamp drive circuit coupled between the high voltage line and the base line, the lamp drive circuit includes a MOSFET;

an output circuit coupled to the lamp drive circuit for producing a lamp drive current used for driving an electric discharge lamp; and a ballast protection circuit for protecting the lamp drive circuit, comprising:

a detection circuit coupled between the high voltage line and the base line configured to detect when a voltage on the high voltage line exceeds a threshold, and a shutoff device coupled to the detection circuit and to a gate of the MOSFET of the lamp drive circuit for preventing the lamp drive circuit from producing the lamp drive current when the detected voltage on the high voltage line exceeds the threshold.

* * * * *